US006699000B2

(12) United States Patent
Moses et al.

(10) Patent No.: US 6,699,000 B2
(45) Date of Patent: Mar. 2, 2004

(54) MACHINE HAVING A WORKING ARM

(75) Inventors: John Moses, Ashbourne (GB); Norman Charles Hadley, Tean (GB)

(73) Assignee: J. C. Bamford Excavators Limited, Staffordshire (GB)

( * ) Notice: Subject to any disclaimer, the term of this patent is extended or adjusted under 35 U.S.C. 154(b) by 0 days.

(21) Appl. No.: 09/840,339

(22) Filed: Apr. 23, 2001

(65) Prior Publication Data

US 2001/0043854 A1 Nov. 22, 2001

(30) Foreign Application Priority Data

May 10, 2000 (GB) ..... 0011138

(51) Int. Cl.[7] ..... E02F 9/14
(52) U.S. Cl. ..... 414/722; 414/685
(58) Field of Search ..... 414/706, 708, 414/710, 712, 722, 713, 711, 685, 700; 180/418

(56) References Cited

U.S. PATENT DOCUMENTS

| | | | | | |
|---|---|---|---|---|---|
| 2,817,448 | A | * | 12/1957 | Pilch | 414/713 |
| 3,253,671 | A | * | 5/1966 | Fielding | 180/418 X |
| 3,429,471 | A | * | 2/1969 | Austin et al. | 414/700 X |
| 3,786,953 | A | * | 1/1974 | Crum et al. | 414/713 |
| 3,913,768 | A | * | 10/1975 | Grooss et al. | 414/711 |
| 4,529,460 | A | * | 7/1985 | Hasegawa et al. | 414/722 X |
| 4,768,917 | A | | 9/1988 | Garman | |
| 5,152,659 | A | | 10/1992 | Waka | |
| 5,611,657 | A | | 3/1997 | Peterson | |
| 5,885,050 | A | * | 3/1999 | Kim | 414/706 X |

FOREIGN PATENT DOCUMENTS

| | | |
|---|---|---|
| EP | 0 382 272 A1 | 8/1990 |
| EP | 0 495 738 A1 | 7/1992 |
| GB | 2 333 759 A | 4/1999 |
| JP | 63 140726 | 6/1988 |
| JP | 9-165773 | 6/1997 |
| JP | 2000-96597 | 4/2000 |
| RU | 2019632 | 9/1994 |

* cited by examiner

*Primary Examiner*—Donald W. Underwood
(74) *Attorney, Agent, or Firm*—Marshall, Gerstein & Borun LLP

(57) ABSTRACT

A machine such as an articulated loading shovel, has a working arm, the machine including a body part to which a first end of the arm is attached for relative pivotal movement about a first generally horizontal axis and the arm having a second end adapted to mount a working implement for movement relative to the arm about a second generally horizontal axis characterized in that the arm is substantially straight between the first and second ends, and is of substantially inverted channel configuration having a top part and a pair of side walls integrally formed, and the arm over at least a major portion of its length between the first and second ends including a strengthening member which extends between and is connected to the side walls.

21 Claims, 3 Drawing Sheets

MACHINE HAVING A WORKING ARM

BACKGROUND TO THE INVENTION

This invention relates to a machine having a working arm and more particularly but not exclusively to a machine known as an articulated shovel which has a first body part connected to a second body part of the machine by an articulated connection which permits of relative movement between the first and second body parts of the machine about a generally upright axis. Usually an engine or other power means for the machine, together with an operator's cab are provided on the second body part, and the first body part mounts the working arm which carries at an end thereof remote from the first body part, a bucket or other working implement.

DESCRIPTION OF THE PRIOR ART

Conventionally articulated loading shovels have had a pair of spaced apart working arms, which are both mounted at first ends thereof on the first body part, and carry between them at their second ends, the bucket or other working implement. A pair of working arms have been provided primarily in order to provide the necessary strength as the arm lifts heavy loads. Thus each arm has usually been provided with its own lifting actuator.

Articulated loading shovels with single working arms of general box configurations have been proposed, for example in GB patent application 2333759. Such box configuration single working arms have advantages over providing a pair of working arms in that the single working arm can be made lighter than comparable twin arm arrangements, thereby improving the lifting performance of the working arm. However a single arm construction can present an obstacle to an operator's sight line and accordingly, in arrangements such as in GB patent application 2333759 such single arms have had complex geometrical configurations such that they are by no means straight. Manufacturing working arms with such complex geometrical configurations adds cost to an otherwise economical construction because the complex configuration arm needs to be fabricated from a plurality of components. Moreover, in the arrangement of GB patent application 2333759, the strength of the working arm is compromised by several cut-outs required for providing a pivotal connection between the arm and the machine, and for tilt links which extend through a slot in the arm and are used in the control and operation of the working implement.

SUMMARY OF THE INVENTION

According to one aspect of the present invention we provide a machine having a working arm, the machine including a body part to which a first end of the arm is attached for relative pivotal movement about a first generally horizontal axis and the arm having a second end adapted to mount a working implement for movement relative to the arm about a second generally horizontal axis characterised in that the arm is substantially straight between the first and second ends, and is of substantially inverted channel configuration having a top part and a pair of side walls integrally formed, and the arm over at least a major portion of its length between the first and second ends including a strengthening member which extends between and is connected to the side walls.

By virtue of this geometrically simple construction, the working arm may be made very economically. To avoid compromising the strength of the arm where the arm is connected to the machine, the body part of the machine may include a pair of mounting members between which the first end of the arm is received, there being a first pivot means which extends between the mounting members and through the side walls of the arm pivotally to attach the arm to the body part. Of course it may be required to strengthen the side walls locally where the first pivot means passes through, but there is no need to provide any slots or the like in the arm to provide a connection to the body part.

Moreover, to ensure that the arm is as strong as possible in the region of connection to the body part, the strengthening member of the arm may extend between the first pivot means and free edges of the side walls of the arm, and if desired the strengthening member of the arm may at least substantially close the channel of the arm at the first end of the arm, and may be connected to the top part of the arm.

Because the strengthening member is a separate component to the integrally formed top part and side walls, and may for example be plate-like, the strengthening member may be formed to a complex configuration prior to its connection e.g. by welding, to and between the side walls.

Whereas a pair of lifting actuators may be provided if desired, preferably the machine includes a single linearly acting lifting actuator which extends between and is pivotally connected to the body part and to the arm, the lifting actuator when extended and retracted causing movement of the arm relative to the body part about the first generally horizontal axis.

The lifting actuator is preferably connected to the arm by a second pivot means, which may include a pivot pin, which is received by the side walls of the arm, with either bearings between the actuator and pin or between the pin and arm, and the strengthening member may be configured to extend between the second pivot means and the top part of the arm. In this way the strengthening member can be configured to present no obstacle to the operation of the lifting actuator.

Preferably though, the strengthening member of the arm, over a major portion of its length, is connected between the side walls adjacent free edges of the side walls. The side walls of the arm may vary in depth along the arm, and may extend for a maximum distance from the top part in the region of connection of the lifting actuator to the arm where maximum strength is required.

To enable the working implement to be moved about the second generally horizontal axis, there may be provided a pair of tilt links, one link of the pair being pivotally attached at each side of the arm to a respective side wall of the arm, the tilt links further each having a first end positioned above the top part of the arm, and a second end positioned below the arm, the first ends of the tilt links being pivotally connected to a linearly acting tilting actuator which extends generally along the arm and is mechanically connected to the working implement at the second end of the arm, and the second ends of the tilt links being pivotally connected to link means which are pivotally connected to the body part of the machine, the tilting actuator when extended and retracted causing movement of the working implement about the second generally horizontal axis.

Thus again no slot or the like is required to accommodate the tilt links. Furthermore, with an appropriate geometry of tilt links, tilting actuator and link means, the working implement can be arranged automatically to maintain an orientation relative to the ground as the working arm is lifted and lowered by the lifting actuator, without the need to extend or retract the tilting actuator.

In one arrangement the tilting actuator is mechanically connected to the working implement at the second end of the arm by a coupling means which includes a coupling member which is pivotally connected at a first pivot connection to the tilting actuator and at a second pivot connection to the working implement, there being a guide means pivotally connected to the coupling member and to the arm, which guide means may include at least one guide member pivotally connected at one end to the coupling member between the first and second pivot connections, and the guide member being pivotally connected at an opposite end to a side wall of the arm.

Although the invention may be applied to any machine having a working arm, the invention has been particularly developed for use where the body part of the machine to which the working arm is attached is a first body part of the machine which is connected to a second body part of the machine by an articulated connection which permits of relative movement between the first and second body parts of the machine about a generally upright axis. The first and second body parts may be relatively articulated about the generally upright axis by linear actuators, and the first and second body parts of the machine may each include a pair of ground engaging wheels, with at least one of the pairs of wheels being driven from a power means, such as an engine, mounted in or on the second body part of the machine via a mechanical and/or hydrostatic transmission.

An operator's cab may be provided on the second body part of the machine, positioned between the power means and the first body part of the machine.

According to a second aspect of the invention we provide a working arm for a machine, the arm having a first end adapted to be attached relative to a body part of the machine for relative pivotal movement about a first generally horizontal axis and a second remote end, adapted to mount a working implement for movement relative to the arm about a second generally horizontal axis, characterised in that the arm is substantially straight between the first and second ends, and is of substantially inverted channel configuration having a top part and a pair of side walls integrally formed by pressing from a blank, and the arm over at least a major portion of its length between the first and second ends including a strengthening member which extends between and is connected to the side walls.

The arm may have any of the features of the arm for the machine of the first aspect of the invention. Particularly the side walls of the arm may vary in depth from the top part, which configuration may be achieved by forming a suitably configured blank to the channel shape of the arm.

For example, the depths of the side walls from the top part may be at a maximum depth at a region of the arm which is adapted to be pivotally connected to a lifting actuator where greatest strength is required.

According to a third aspect of the invention we provide a working arm for a machine, the arm having a first end adapted to be attached relative to a body part of the machine for relative pivotal movement about a first generally horizontal axis and a second remote end, adapted to mount a working implement for movement relative to the arm about a second generally horizontal axis, characterised in that the arm is substantially straight between the first and second ends and the arm includes a tilt mechanism including a pair of tilt links, one link of the pair being pivotally attached at each side of the arm to a respective side wall of the arm, the tilt links further each having a first end positioned above the arm, and a second end positioned below the arm, the first ends of the tilt links being pivotally connected to a linearly acting tilting actuator which extends generally along the arm and is in use, mechanically connected to the working implement at the second end of the arm, and the second ends of the tilt links being pivotally connected to link means which are pivotally connected in use to a body part of the machine.

According to a fourth aspect of the invention we provide a method of making a working arm according to the second or third aspects of the invention including the steps of cutting from a sheet of material, a blank, forming the blank into a substantially straight channel shape having a top part and a pair of side walls, and thereafter, over at least a major portion of the length of the channel connecting a strengthening member to each of the side walls so as to extend therebetween.

BRIEF DESCRIPTION OF THE DRAWINGS

The invention will now be described with reference to the accompanying drawings in which.

DESCRIPTION OF THE PREFERRED EMBODIMENTS

Figure 1:
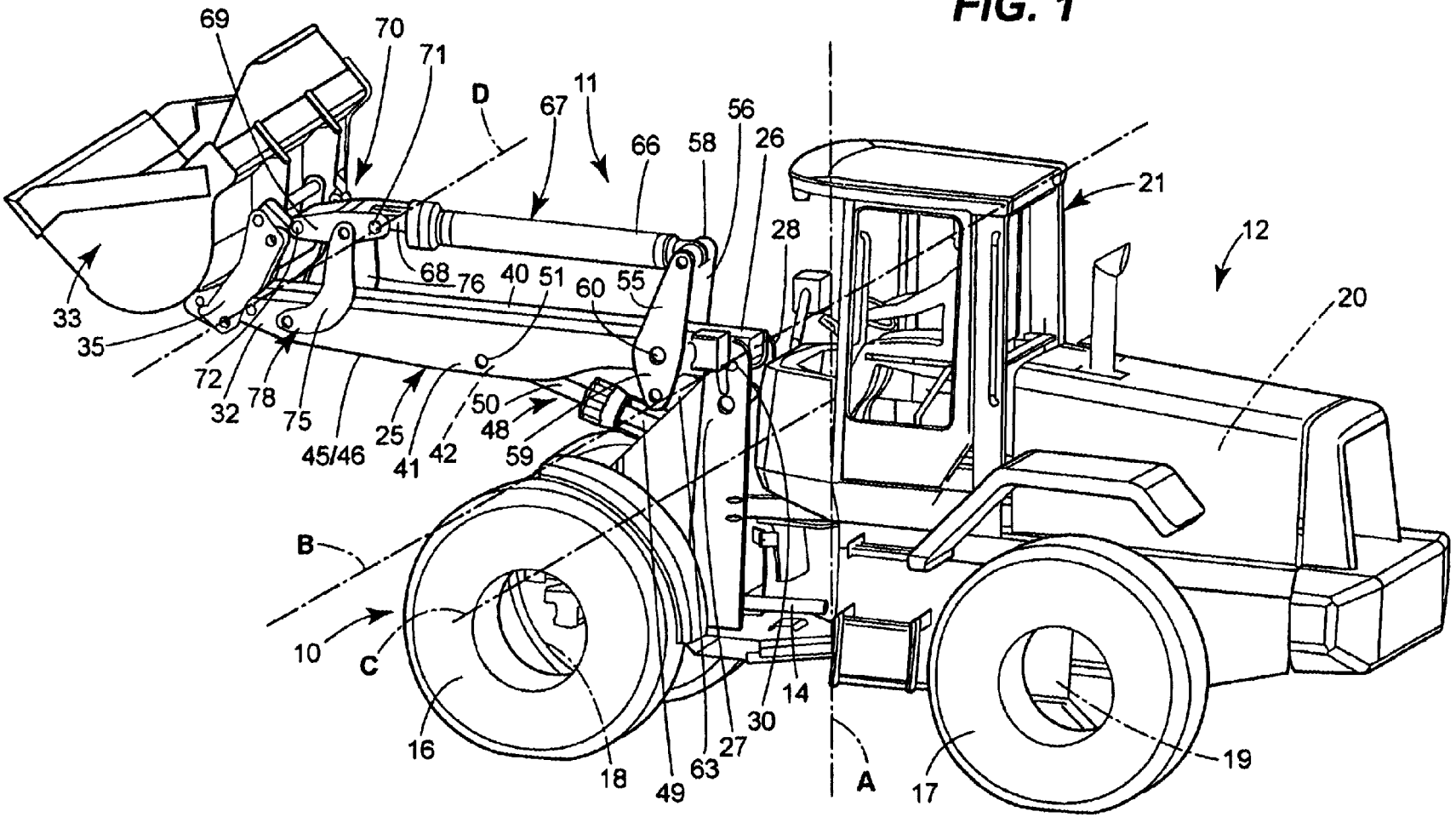
FIG. 1 is an illustrative perspective view of a machine having a working arm, in accordance with the invention.
Figure 2:
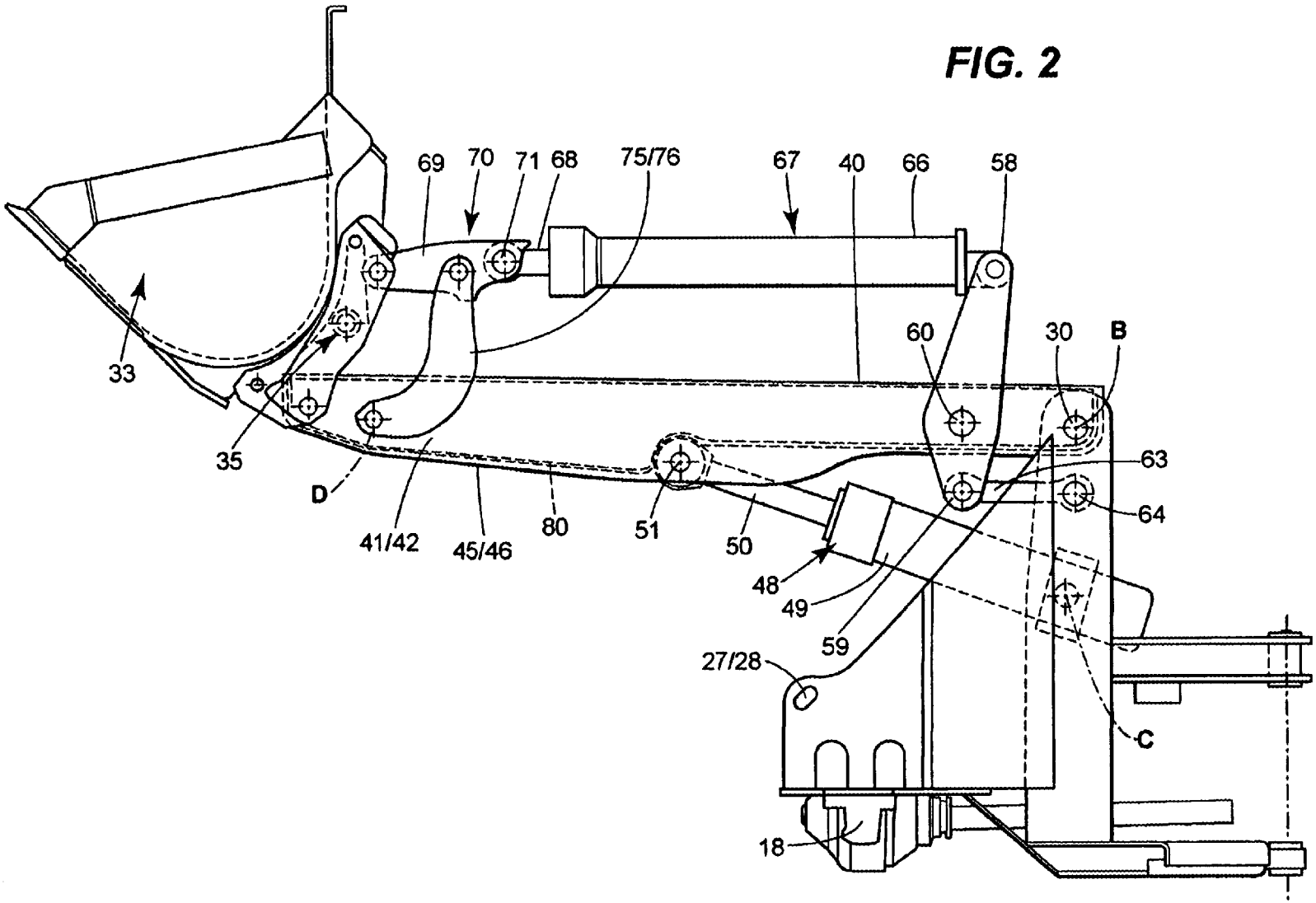
FIG. 2 is a side detailed view of part of the machine of FIG. 1.

Referring to FIGS. 1 and 2 of the drawings, a machine 10 of the kind known as an articulated loading shovel, includes a first, front, body part 11 and a second, rear, body part 12, the first and second body parts 11, 12 being articulated for relative movement about a generally upright axis A, by linear acting hydraulic actuators, the position of one of which being indicated in the drawings at 14. Each body part 11, 12 has a pair of ground engaging wheels 16, 17 respectively, carried on respective axles 18, 19, and the wheels 16, 17 being driven via a mechanical and/or hydrostatic transmission from an engine the position of which is indicated at 20, provided on the second body part 12.

Thus the machine 10 may be driven over the ground, and steered by relatively articulating the body parts 11, 12. The machine 10 is controlled from an operator's cab 21 positioned on the second body part 12 between the engine 20 and the first body part 11.

The machine 10 includes a working arm 25 which is pivotally connected at a first end 26 thereof, to the first body part 11. To achieve this, the first body part 11 includes a pair of mounting members 27, 28 which provide a space between them in which the first end 26 of the arm 25 is received. A pivot pin 30 extends through the mounting members 27, 28 and through the arm 25 as hereinafter described.

At a second end 32 of the working arm 25, there is mounted a working implement 33 which in this example is a bucket, with there being a so called "quick hitch" device 35 on the arm 25 to facilitate mounting buckets of different configuration and capacity at the second end 32 of the arm 25.

In accordance with the present invention, the working arm 25 is of substantially inverted channel configuration having a top part 40 and a pair of depending integrally formed, side walls 41, 42. The arm 25 is substantially straight between the first 26 and second 32 ends thereof and of generally constant width. The top part 40 and side walls 41, 42 are formed by pressing from a blank (shown at B in FIG. 3) as described hereinafter. The depths of the side walls 41, 42 from the top part 42 to free edges 45, 46 thereof, vary along the length of the working arm 25. This configuration is achieved with no or minimal machining, i.e. during the pressing operation.

The pivot pin 30 which connects the first end 26 of the working arm 25 to the mounting members 27, 28 passes through openings in the side walls 41, 42 of the arm 25, which openings may have journalled therein, bearings. Alternatively, or in addition, the pivot pin 30 may be fixed relative to the arm 25, and be received by bearings journalled in openings in the mounting members 27, 28 which receive the pivot pin 30. In each case, the openings in the side walls 41, 42 of the arm 25 and/or in the mounting members 27, 28 may be strengthened, e.g. by attaching keyhole castings, as is well known in the art.

The working arm 25 may be moved about a first generally horizontal axis B co-incident with the axis of the pivot pin 30, relative to the first body part 11 of the machine 10, to lift and low the arm 25, by a single linearly acting hydraulic actuator 48. In this example a cylinder part 49 of the actuator 48 is pivotally connected to the first body part 11 intermediate the ends of the cylinder part 49, for pivoting relative to the first body part abut an axis C, whilst a piston part 50 of the actuator 48 is pivotally connected to the working arm 25. In another arrangement the actuator 48 may be reversed so that the piston part 50 is pivotally connected to the first body part 11 and the cylinder part 49 to the arm 25. However the arrangement described is preferred, particularly with the cylinder part 49 being pivoted intermediate its ends for pivoting about axis C, as the actuator 48 can then occupy less space forwardly of the axis C than the required stroke of the actuator 48. This connection may be a so-called trunnion mounting.

The pivotal connection of the lifting actuator 48 with the arm 25 is provided by the piston part 50 of the actuator 48 having a so-called hammer head construction, with there being a pivot pin 51 ends of which are received in openings in the side walls 41, 42 of the working arm 25 with the piston part 50 of the actuator 48 providing a bearing connection with the pin 51. Thus as the lifting actuator 48 is extended and retracted, the actuator 48 may pivot relative to the first body part 11 and relative to the working arm 25, as the working arm 25 is raised and lowered.

It can be seen that the depths of the side walls 41, 42 of the working arm 25 are at a maximum in the region of the pivotal connection (pins 51) of the lifting actuator 48 to the arm 25, where maximum strength is required.

The working implement 33 is pivotally mounted at the second end 32 of the working arm 25, for pivotal movement relative to the arm 25 about a generally horizontal axis D. To achieve such pivotal movement, a tilt mechanism is provided which includes a pair of tilt links 55, 56 pivotally mounted to respective side walls 41, 42 of the arm 25 at a position adjacent the first end 26 of the arm 25. The tilt links 55, 56 each have a first upper end 58 located above the top part 40 of the arm 25, and a lower second end 59 located below the arm 25. A pivot pin 60 extends through the side walls 41, 42 of the arm 25 and has the tilt links 55, 56 mounted on the ends thereof, again with bearings being provided in openings in the side walls 41, 42 of the arm 25, in which the ends of the pivot pin 60 are journalled.

The second lower ends 59 of the tilt links 55, 56 are each pivotally connected to one or one of a pair of link 63, which are pivotally connected to the first body part 11 of the machine 10 at the position indicated at 64, e.g. by a pivot pin received in the mounting members 27, 28. The first upper ends 58 of the tilt links 55, 56 are pivotally connected to one end, in this example a cylinder end 66, of a linearly acting tilting actuator 67. A piston end 68 of the tilting actuator 67 is connected to a first pivot connection 71 of a coupling member 69 of a coupling means 70 which couples the tilting actuator 67 to the working implement 33. A second pivot connection 72 of the coupling member 69 is pivotally connected to the quick hitch 35 of the working implement 33. Intermediate the first and second pivot connections 71, 72 of the coupling member 69, the coupling member 69 is pivotally connected to a pair of guide members 75, 76 of a guide means 78. Each guide member 75, 76 depends from the coupling members 69 either side of the arm 25, and is pivotally connected to a respective side wall 41, 42 of the arm 25.

The geometry of the tilt mechanism is such that when the working implement 33 is set in an orientation relative to the ground by extending or retracting the tilt actuator 67, when the lifting actuator 48 is operated to raise or lower the arm 25, the working implement 33 will retain its orientation relative to the ground. Thus the tilt mechanism is so-called self levelling, without it being necessary to extend and/or retract the tilt actuator 67 during lifting and lowering of the arm 25, at least over a large range of lifting/lowering movement of the arm 25.

When it is desired to change the orientation of the working implement 33 relative to the ground, for example to load or unload the bucket thereof, the tilt actuator 67 will of course need to be extended and/or retracted.

Figure 3:
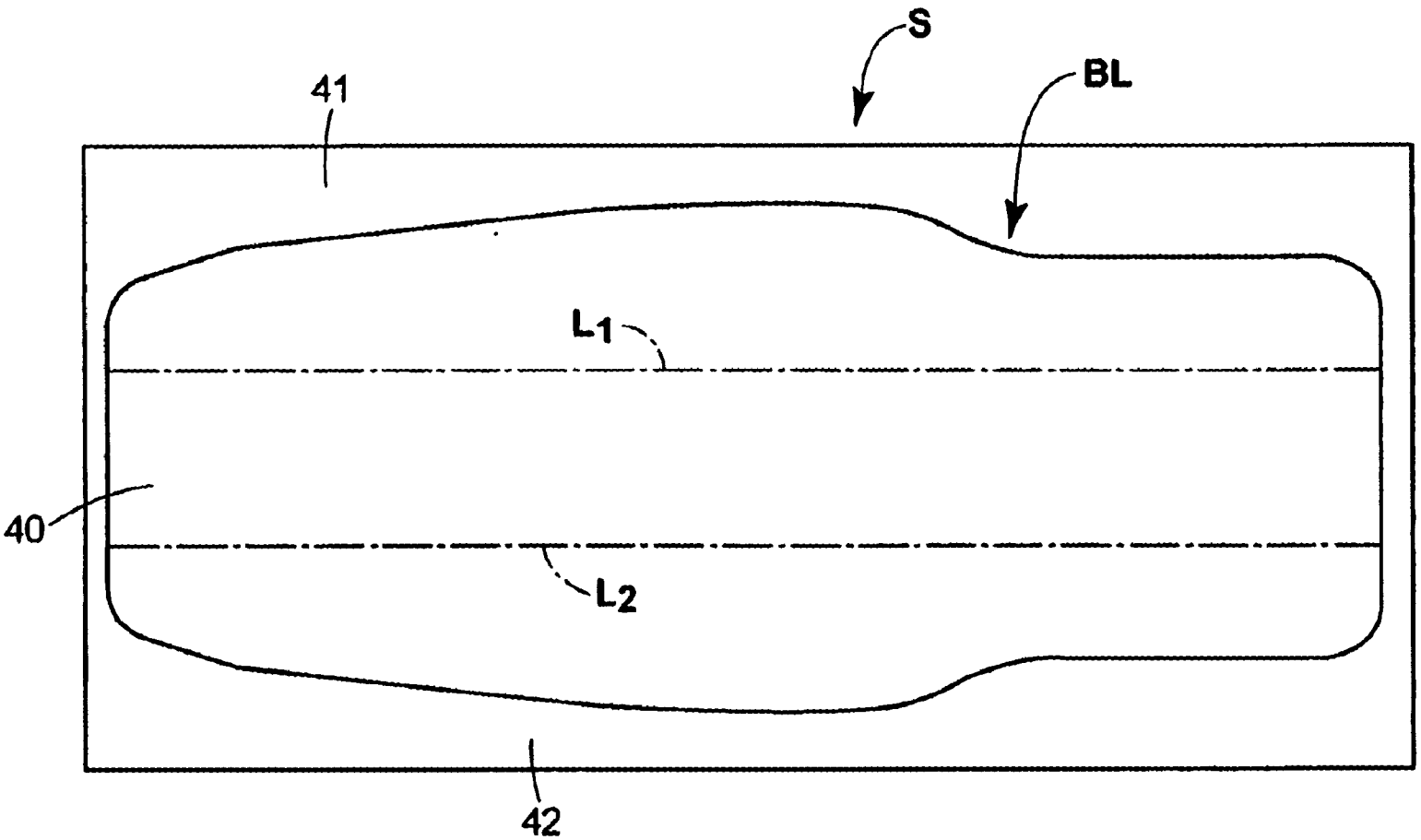
FIG. 3 is an illustrative plan view of the working arm of the machine of FIGS. 1 and 2, at a phase during construction.

Referring to FIG. 3, a stage during manufacture of the arm 25 is indicated. A blank BL is cut from a sheet S of material, the blank BL being configured so that during subsequent forming of the blank BL, the top part 40 and side walls 41, 42 substantially to the configuration shown in the other figures, are integrally formed. Thus fold lines are indicated at L1 and L2 along which the blank 13L is folded, in pressing operation to form the arm 25. The various openings for pivot pins, such as pins 30, 51, 60 etc., are preferably provided subsequent to forming, but may be provided by punching from the blank BL if desired.

The arm 25 being substantially straight and of generally constant width along the entire length of the arm 25, formed in this manner will be strong and light. However to add further strength, in accordance with the invention, a strengthening member 80 is provided, the configuration of which is best seen in FIG. 2.

The strengthening member 80 is preferably formed from a plate-like structure, and is connected, typically by welding, to each of the side walls 41, 42, interiorially of the channel shape of the arm 25. Over a major part of the length of the arm 25, the strengthening member 80 is positioned close to the free edges 45, 46 of the side walls 41, 42, so as to provide a void within the arm 25 which may convey hydraulic and/electrical control lines if desired.

In the region of connection of the arm 25 to the lifting actuator 48, where the side walls 41, 42 are of maximum depth, the strengthening member 80 extends between the pivotal connection 51 and the top part 40 of the arm. Thus the strengthening member 48 does not inhibit lowering of the arm 25 by obstructing the lifting actuator 48.

The pivot pins 30 (to connect the arm to the mounting members 27, 28) and 60 (for the tilt links 55, 56) are however contained within the void of the arm 25 with the strengthening member 80 beneath the pivotal connections, adjacent the free edges 45, 46 of the side walls 41, 42. At the first end 26 of the arm 25, the strengthening member 80 is configured to close or at least substantially close the end of the arm 25, and in the example shown, the strengthening member 80 is connected, by welding to the underside of the top part 40.

In the particular example illustrated in the drawings, the arm 25 is about 3 m in length, about 400 mm wide, and the maximum depths of the side walls 41, 42, in the region of the pivotal connection 51 to the lifting ram 48, is about 300 mm. The sheet S from which the blank B is cut, typically may have a thickness of about 15 mm only. These dimensions are given for illustrative purposes only, and may significantly be varied.

Various modifications in addition to those already identified may be made without departing from the scope of the invention. For example, the articulated connection between the first and second 11, 12 body parts may permit of some relative pivotal movement about a longitudinal axis of the machine in addition to the upright axis A. Preferably though the articulated connection only permits movement about upright axis A with the axle 18 on which the wheels 17 of the rear second body part 12 are mounted, being mounted for oscillation about a longitudinal axis relative to the second body part 12.

If desired an alternative tilting mechanism geometry to that described may be provided. For example the tilting actuator 67 may be provided beneath the arm 25, and/or the positions of the tilt actuator 67 and the links 63 which connect the tilt links 55, 56 and the first body part 11 may be transposed.

In each case preferably the integrity of the arm 25 is not compromised by the provision of any slot of the like to accommodate any component part of the tilt mechanism and/or to pivotally mount the arm 25 on the first body part 11 of the machine 10.

The invention may be applied to other kinds of machine entirely to the articulated loading shovel described, for example to a non-articulated loading or excavating/loading machine, having a working arm and steerable wheels or even tracks. However the invention has particular application where the working arm is mounted generally centrally of a body part of the machine, so as to extend forwardly of an operator's cab 21, where a working arm 25 constructed and configured as described, can provide for good visibility for an operator from the cab 21 during working operations.

Whereas the strengthening member 80 preferably is a unitary member which extends substantially from one end of the arm 25 to the other, in another example, the strengthening member 80 may be made up from separate parts and need only be provided along the arm 25 where strengthening is required.

The features disclosed in the foregoing description, or the following claims, or the accompanying drawings, expressed in their specific forms or in terms of a means for performing the disclosed function, or a method or process for attaining the disclosed result, as appropriate, may, separately, or in any machine of such features, be utilised for realising the invention in diverse forms thereof.

What is claimed is:

1. A machine having only a single monolithic working arm, the machine including a body part to which a first end of the arm is attached for relative pivotal movement exclusively about a first generally horizontal axis and the arm having a second end adapted to mount a working implement for movement relative to the arm about a second generally horizontal axis wherein the arm is substantially straight between the first and second ends, and is of substantially inverted channel configuration having a continuous top part and a pair of side walls integrally formed, each of the side walls including a free edge, and the arm over at least a major portion of its length between the first and second ends including a strengthening member which extends between and is connected to the side walls, the arm having a central pivot region defined by the sidewalls and disposed centrally between the first and second ends, the pivot region arranged to receive an actuator, the strengthening member extending between the side walls generally adjacent to the free edges of the sidewalls along at least a portion of the length of the arm, the strengthening member having a section shaped to avoid the pivot region.

2. A machine according to claim 1 wherein the body part of the machine includes a pair of mounting members between which the first end of the arm is received, there being a first pivot means which extends between the mounting members and through the side walls of the arm pivotally to attach the arm to the body part.

3. A machine according to claim 2 wherein the strengthening member of the arm extends between the first pivot means and the free edges of the side walls of the arm.

4. A machine according to claim 3 wherein the strengthening member of the arm at least substantially closes the channel of the arm at the first end of the arm, and is connected to the top part of the arm.

5. A machine according to claim 1 wherein the machine includes a single linearly acting lifting actuator which extends between and is pivotally connected to the body part and to the central pivot region of the arm, the lifting actuator when extended and retracted causing movement of the arm relative to the body part about the first generally horizontal axis.

6. A machine according to claim 5 wherein the lifting actuator is connected to the arm by a second pivot means which is received by the side walls of the arm, the strengthening member being configured to extend between the second pivot means and the top part of the arm.

7. A machine according to claim 1 wherein the strengthening member of the arm includes and upwardly extending portion at each of the first and second ends, each of the upwardly extending portions extending between the free edges of the side walls and joined to the top part.

8. A machine according to claim 5 wherein the side walls of the arm extend for a maximum distance from the top part in the region of connection of the lifting actuator to the arm.

9. A machine according to claim 1 wherein there are provided a pair of tilt links, one link of the pair being pivotally attached at each side of the arm to a respective side wall of the arm, the tilt links further each having a first end positioned above the top part of the arm, and a second end positioned below the arm, the first ends of the tilt links being pivotally connected to a linearly acting tilting actuator which extends generally along the arm and is mechanically connected to the working implement at the second end of the arm, and the second ends of the tilt links being pivotally connected to link means which are pivotally connected to the body part of the machine, the tilting actuator when extended and retracted causing movement of the working implement about the second generally horizontal axis.

10. A machine according to claim 9 wherein the tilting actuator is mechanically connected to the working implement at the second end of the arm by a coupling means which includes a coupling member which is pivotally connected at a first pivot connection to the tilting actuator and at a second pivot connection to the working implement, there being a guide means pivotally connected to the coupling member and to the arm.

11. A machine according to claim 10 wherein the guide means includes at least one guide member pivotally connected at one end to the coupling member between the first and second pivot connections, and the guide member being pivotally connected at an opposite end to a side wall of the arm.

12. A machine according to claim 1 wherein the body part of the machine to which the working arm is attached is a first body part of the machine which is connected to a second body part of the machine by an articulated connection which permits of relative movement between the first and second body parts of the machine about a generally upright axis.

13. A machine according to claim 12 wherein the first and second body parts of the machine each include a pair of ground engaging wheels with at least one of the pairs of wheels being driven from a power means mounted in or on the second body part of the machine.

14. A machine according to claim 12 wherein the machine includes an operator's cab provided on the second body part of the machine.

15. A machine according to claim 13 wherein the machines includes an operator's cab provided on the second body part of the machine, the cab being positioned between the power means and the first body part of the machine.

16. A working arm for a machine, the arm having a first end adapted to be attached relative to a body part of the machine for relative pivotal movement exclusively about a first generally horizontal axis, the arm including a second remote end adapted to mount a working implement for movement relative to the arm about a second generally horizontal axis, wherein the arm is substantially straight between the first and second ends and includes a central pivot region between the ends and arranged to receive an actuator, and wherein the arm is of substantially inverted channel configuration having a top part and a pair of side walls integrally formed by pressing from a blank, and the arm over at least a major portion of its length between the first and second ends including a strengthening member which extends between and is connected to the side walls, and wherein the pivot region is defined at least in part by the side walls, each of the side walls having lower free edges which extend beyond the strengthening member in an area adjacent to the pivot region.

17. An arm according to claim 16 wherein side walls of the arm vary in depth from the top part.

18. An arm according to claim 17 wherein the depths of the side walls from the top part are at a maximum depth at a region of the arm which is adapted to be pivotally connected to a lifting actuator.

19. A working arm for an articluated machine having only a single arm, the arm having a first end adapted to be attached relative to a body part of the machine for relative pivotal movement exclusively about a first generally horizontal axis and the arm further including a second remote end, the second remote end adapted to independently support a working implement for movement relative to the arm about a second generally horizontal axis, wherein the arm is substantially straight between the first and second ends and the arm includes a tilt mechanism including a pair of tilt links, one link of the pair being pivotally attached at each side of the arm to a respective side wall of the arm, the tilt links further each having a first end positioned above the arm, and a second end positioned below the arm, the first ends of the tilt links being pivotally connected to a linearly acting tilting actuator which extends generally along the arm and is in use, mechanically connected to the working implement at the second end of the arm, and the second ends of the tilt links being pivotally connected to link means which are pivotally connected in use to a body part of the machine, the arm having an inverted channel configuration formed from a top wall and a pair of sidewalls and having a pivot region formed in the sidewalls and centrally disposed between the ends, the pivot region adapted to receive a lifting actuator, each of the sidewalls including a free edge, and further including a strengthening member mounted between the sidewalls generally adjacent to the free edge of each of the sidewalls, the strengthening member extending from adjacent the first end to adjacent the second end, the strengthening member including a central portion shaped to avoid the pivot region.

20. An articulated shovel machine for use with a working implement and comprising:

a first body part and a second body joined to articulate about a generally vertical axis;

a working arm having a first end, a second end, and a pivot region adapted to receive a lifting actuator and disposed between the first and second ends, the first end attached to the first body part for pivoting movement relative to the first body part exclusively about a horizontal axis, the second end adapted to receive the working implement;

the working arm including a substantially straight top wall and a pair of sidewalls extending between the first end and the second end, the sidewalls integrally formed with the top wall and depending downwardly from the top wall, the top wall and the sidewalls cooperating to form an inverted channel configuration, each of the sidewalls including a free edge;

a strengthening member connected to the sidewalls along an interior of the working arm and extending at least a major portion of a length of the working arm, the strengthening member including a first portion disposed between the pivot region and the first end, a second portion disposed between the pivot region and the second end, and a third portion curving around the pivot region.

21. The articulated shovel machine of claim 20, wherein the strengthening member extends upwardly adjacent each of the ends of the arm and is joined to the top wall.

* * * * *